US005584732A

United States Patent [19]

Owen

[11] Patent Number: 5,584,732

[45] Date of Patent: Dec. 17, 1996

[54] HUMAN-POWERED WATERCRAFT PADDLE PROPULSION SYSTEM

[75] Inventor: Charles R. Owen, Maumelle, Ark.

[73] Assignee: Kakor Inc., Dallas, Tex.

[21] Appl. No.: 582,530

[22] Filed: Jan. 11, 1996

[51] Int. Cl.[6] ..... B63H 16/08

[52] U.S. Cl. ..... 440/13; 440/24

[58] Field of Search ..... 440/13, 21, 22, 440/23, 24, 25, 26, 27, 28, 29, 30, 31, 32; 114/144 R, 153

[56] References Cited

U.S. PATENT DOCUMENTS

| | | | |
|---|---|---|---|
| 2,633,096 | 3/1953 | Rayfield | 440/24 |
| 3,095,850 | 7/1963 | Stolzer | 440/24 |
| 4,960,396 | 10/1990 | Stolzer | 440/24 |
| 5,011,441 | 4/1991 | Foley et al. | 440/26 |
| 5,453,031 | 9/1995 | Gagnier | 440/26 |

FOREIGN PATENT DOCUMENTS

| | | | |
|---|---|---|---|
| 1315814 | 4/1963 | France | 440/26 |

*Primary Examiner*—Stephen Avila
*Attorney, Agent, or Firm*—Stephen D. Carver; Trent C. Keisling

[57] ABSTRACT

A human-powered, foot or hand operated paddle propulsion system for a variety of differently sized and configured watercraft. A rigid supporting subframe attaches the system to an end of the watercraft. A spaced-apart terminus is wedged towards a boat seat base. The terminus and subframe cooperatively secure the system within the boat. The subframe has a C-shaped bow plate coupling it to the boat end. The paddle assembly is removably quick-connected to the bow plate. Knobbed, slidably adjustable mounting bolts captivate the subframe upon the bow. The frame comprises a pair of adjustable, telescoping frame beams that enable it to retract or extend. The frame supports an adjustable actuating assembly including foot-operated pedals and optional hand bars for powering the boat. Cabling links the actuating assembly to the drive paddle assembly. Slidable captivation of the activating assembly upon the frame facilitates cable length and tension adjustments. The cabling extends through the frame and around the drive paddle assembly between terminal ends on each foot pedal. The subframe buttresses the drive paddle assembly. The drive paddle assembly controls paddle pitch and sweep. A spring lock may be used to lock a cable guide donut in a selected pitch-controlling position. The lock maintains donut positioning until released.

13 Claims, 9 Drawing Sheets

HUMAN-POWERED WATERCRAFT PADDLE PROPULSION SYSTEM

BACKGROUND OF THE INVENTION

I. Field of the Invention

The present invention relates generally to human powered propulsion systems for watercraft. More particularly, this invention relates to a pedal-driven sculling paddle assembly that can be removably mounted upon a variety of small boats. Known relevant prior art may be found in U.S. Class 440, Subclass 24.

II. Description of the Prior Art

I have invented a new human-powered paddle system that may be easily mounted upon a wide variety of conventional watercraft. The system propels the boat by oscillating a bow-mounted paddle with cables driven by foot pedals. The system may be installed and operated without modification of the watercraft's structure. When installed, the system permits continued, unobstructed passenger access to substantially all of the watercraft interior.

A variety of prior art systems relating to human-powered watercraft exists. For example, known foot operated paddle systems most closely related to the concepts of this invention can be found in the patent records in U.S. Class 440, Subclasses 13, 21 and 24. The two most relevant prior art patents known to me comprise U.S. Pat. No. 3,095,850 issued Jul. 2, 1963, and U.S. Pat. No. 4,960,396 issued Oct. 2, 1990. The disclosures of the last-mentioned patents are hereby incorporated by reference.

The aforementioned patents disclose watercraft propulsion devices having a single paddle that is operated by a pair of cables. A foot-operated pedal arrangement tensions the cables. When pressure on one pedal exceeds pressure on the other, two basic paddle movements are produced. First, the paddle is rotated about its longitudinal axis every stroke to establish pitch. Secondly, for propulsion, the paddle is vigorously pivoted within a plane that is both parallel with the bow and generally perpendicular to the longitudinal axis of the watercraft. When a user alternates tension on the pedals, blade pitch is also alternated to preserve the selected direction of travel.

Another blade movement results if both foot pedals are pressured at once. A cable-controlling "donut" flips over in response to the sum of the pressure from both cables and reverses the alternate blade pitch movements established by rotation of the blade about its longitudinal axis. Thus, when both foot pedals are pressed in unison, the total cable pressure reverses the direction of travel. As long as pressure on one foot pedal exceeds the non-zero pressure on the other pedal, the alternate power strokes that follow reverse the craft.

In addition to the paddle movements mentioned above, U.S. Pat. No. 4,960,396 discloses paddle structure characterized by a "break-away" motion. In this case, unintended impact with submerged obstacles can nondestructively dislodge the blade from its normal orientation to prevent paddle breakage.

U.S. Pat. No. 4,353,703 issued Oct. 12, 1982 discloses a foot-operated, marine propulsion system that can be retrofitted to small watercraft. A pair of spaced-apart paddles are driven by human power. U.S. Pat. No. 3,680,522 Aug. 1, 1972 depicts a pedal-powered boat drive mechanism with a drive shaft. Other prior art known to me comprises U.S. Pat. Nos. 4,323,352; 4,345,903; 3,467,049; 4,172,426; 4,231,309; 3,056,977; 3,038,435.

No known prior art system is adapted to be removably installed upon existing watercraft. In other words, modifications to the existing watercraft structure are always required. Known systems often require elaborate means for attaching them to the watercraft superstructure, and in many cases the systems are severely limited as to boat size ranges with which they may be used. Further, many prior systems tend to clutter up the boat interior, adding inconvenient obstructions to the boat occupants.

Systems such as those disclosed in U.S. Pat. Nos. 3,095,850 and 4,960,396 discussed above have numerous other disadvantages. One problem is that they may strain the bow of the boat. Typical smaller watercraft have somewhat flexible characteristics, and the stress of the normal tensioned drive pulleys and related apparatus can deform, if not break, the transom or bow of the watercraft. Also, when prior art devices are firmly attached to the boat interior, the resultant forces may be unevenly distributed. For example, a clamp firmly attached to a given area will apply too much force to a limited area, causing breakage or damage. Therefore operating forces developed by a viable system must be properly distributed upon the watercraft structure.

Often the drive cable is a problem. It is frequently noisy and difficult to adjust and position. Being of constant length, the system fails when the cables are too long, and the devices cannot be used at all when the cables are too short. No quick connection or quick adjustment means have hitherto been provided to adequately address the cable length problem inherent in such devices.

Another characteristic design problem relates to the method of reversing propulsion. The above-discussed Stolzer devices require the operator to pressure both pedals when reversing direction. Such added effort can fatigue some users, decreasing both range and speed.

SUMMARY OF THE INVENTION

My invention comprises a human-powered, foot-operated paddle propulsion system for watercraft. The system adapts itself for use with a variety of differently sized and configured watercraft. It is compact and efficient, and its use does not deleteriously affect the watercraft structure.

In the best mode, a rigid supporting subframe mounts the system to the bow of the watercraft. A spaced-apart terminus rests on a selected boat seat base. The terminus and the subframe cooperatively wedge the system into the boat. The terminus may also be sat upon by the user to further secure the system in the boat.

The subframe comprises a C-shaped bracket that couples the subframe to the bow or stern of the boat. The bracket encloses a selected portion of the boat. Opposing, adjustable bolts threadably mounted to the bracket selectively tighten upon the enclosed portion of the boat to secure the subframe thereto. The bracket functions with either V-shaped or blunt boat ends. The adjustable bolts compensate for the various bow shapes and sizes.

The subframe supports one end of the frame. The frame extends from the subframe to a spaced-apart terminus that supports the other frame end. The terminus rests upon a user selected boat seat base to anchor and support the system. Tightening of the subframe bow bracket wedges the terminus into position. The terminus is additionally secured by the weight of the optional, clamp-on swivel seat and the operator. In operation, the terminus thus distributes forces about the boat structure.

Preferably, the frame comprises a pair of elongated, hollow, beams. The beams telescope together so that the overall frame length may be selectively adjusted to fit different boats. The frame also supports an adjustable actuating assembly comprising foot-operated pedals. In the preferred embodiment, the actuating assembly sleeves over the rear beam to permit longitudinal adjustment. Thus, a user may adjust the distance of the actuating assembly from the seat for comfort and convenience. Pedals coupled to the actuating assembly may be foot-driven by a user to propel the boat. A cable links the actuating assembly to the drive paddle assembly, and numerous cable length and tension adjustments are possible.

Preferably, the drive cable is a single, continuous wire rope covered by plastic. In the preferred embodiment, the frame protectively houses a substantial portion of the drive cable. The cable extends through the frame and around the drive paddle assembly between terminal ends on each foot pedal. The cable slides over three sets of appropriately placed guide pulleys. Pulley sets are associated with the rear terminus, the pivot housing, and spreader arms at the subframe. Cables are also constrained by anchor and guide spools on the foot pedals.

The subframe buttresses the drive paddle assembly. The drive paddle assembly controls paddle orientation or "pitch" and movement or "sweep". The principal components and operation of the drive paddle assembly are more fully discussed in U.S. Pat. Nos. 3,095,850 and 4,960,396, both of which are incorporated by reference herein. As is discussed therein, cable controls paddle pitch in conjunction with a spring-biased donut. Normally, the donut is biased so that pitch propels the boat rearwardly. When the cable is tensioned on both ends, the donut flips over and changes the resultant paddle pitch to transpose the direction (i.e., the boat moves forwardly in the direction the bow points).

Previously, the spring automatically returned the cable guide donut to the reverse movement position when the user relaxed tension on either pedal. A new spring lock disclosed herein may be used to selectively, temporarily lock the cable guide donut the forward position, even after the user relaxes cable tension. Preferably, the spring lock automatically releases the donut when the cabling is appropriately tensioned by pressing with both feet.

In operation the drive paddle assembly is preferably oriented in a vertical, upright position with the paddle blade occupying a plane generally perpendicular to the water. During use the pedals are manipulated to control the pitch and sweep of the paddle to selectively propel the boat. By changing the foot tension applied to the pedals, the user may quickly and easily reverse direction. The spring lock permits the user to selectively maintain a particular paddle pitch.

Thus, a broad object of the present invention is to provide an improved human-operated paddle system for propelling small boats through the water.

Another object is to provide a foot-operated paddle system that readily empowers a user to propel and maneuver the craft in numerous selected directions.

A similar broad object is to provide a foot-operated paddle system for small boats that is ergonomically efficient.

Another important object is to provide a human-powered paddle system of the character described that more evenly distributes cable-generate forces to reduce resultant pressures on the structure of the boat upon which the device is attached.

A further broad object is to provide an improved human-operated paddle system for small boats that readily installs upon practically any small, flat-bottom boat from eight to eighteen feet in length.

Another object is to provide a foot-operated paddle system of the character described that overcomes cabling problems that have hitherto afflicted similar prior art devices.

A related object is to provide a highly efficient and easily adjustable cable system that is quiet and smooth.

Yet another object is to allow complete passenger access to the boat interior during use. Thus a related another object is to minimize interior obstructions.

Another object is to provide a frame for a system of the character described that compactly houses apparatus responsible for all functions.

A still further object is to firmly lock the system in place during use. It is a feature of the invention that the weight of the user assists and enhances locking.

Another object is to provide a paddle system that easily accommodates different depths of water.

Still another object is to provide a mounting bracket for the system described that locks tightly and reliably on both straight and V-shaped bows or sterns.

Yet another object is to provide a precise cable take-up system that allows the device to be fine tuned for optimum performance.

A still further object is to provide a system of the character described that, once removed from the boat, foldably collapses into a compact orientation suitable for storing and transporting in a simple carrying bag.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figures 1, 1A:
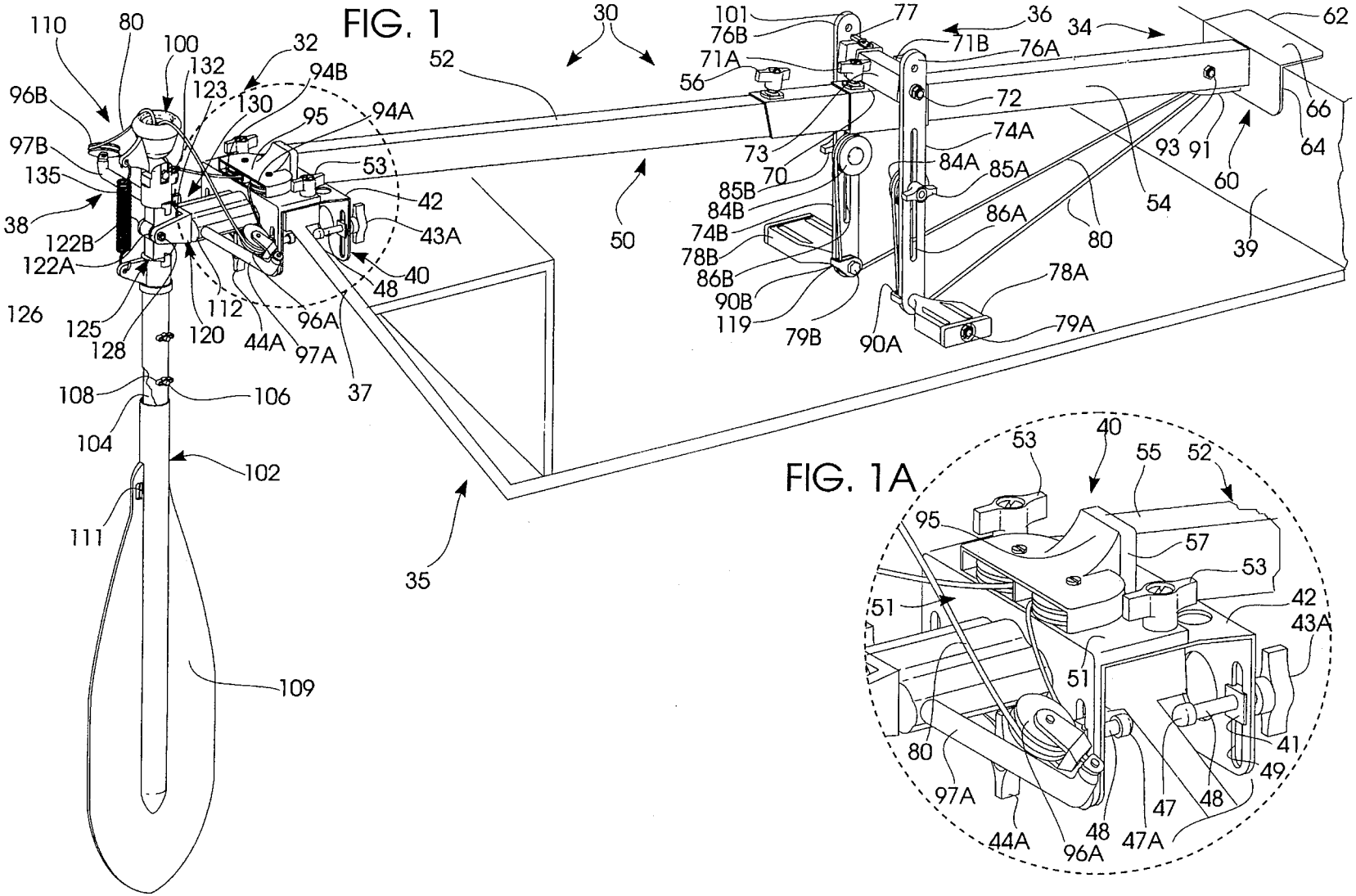
FIG. 1 is an isometric view showing a preferred embodiment of the watercraft propulsion system mounted in a conventional flat-bottomed boat, with the optional swivel seat omitted for brevity.
FIG. 1A is an enlarged, fragmentary isometric view of that portion of FIG. 1 circled in dashed lines.
Figure 2:
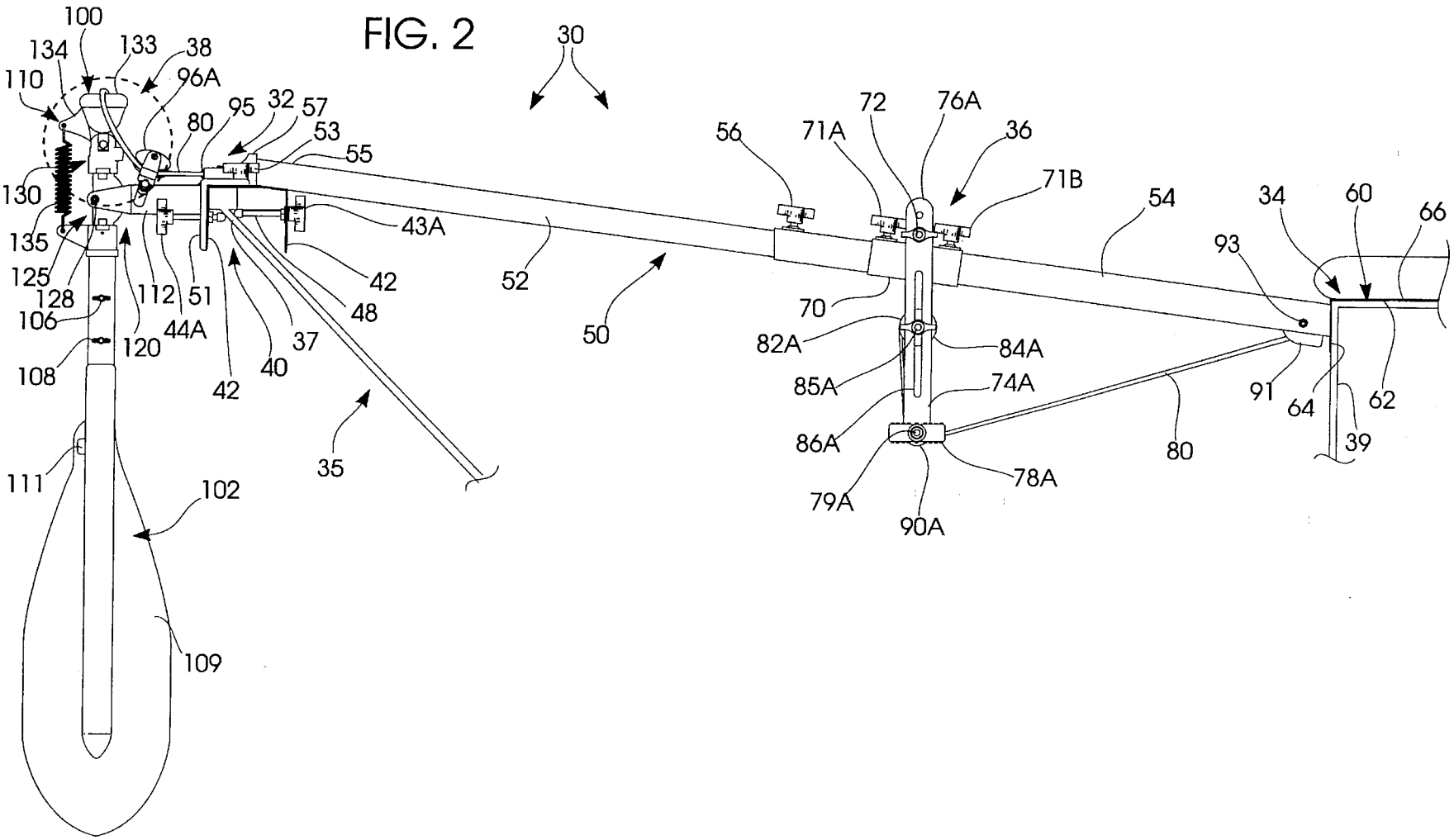
FIG. 2 is a fragmentary, side elevational view of the system, with the opposite side being a mirror image thereof and with portions of the boat broken away or omitted for clarity.

Referring more specifically to the drawings, my improved foot-operated paddle propulsion system for watercraft is generally designated by reference numeral 30 (FIGS. 1–7). The system front 32 mounts upon either the bow or stern of a watercraft while the rear 34 rests upon a seat base within the boat. Almost any watercraft, such as a conventional flat-bottom boat 35, may be retrofitted with system 30. Ideally system 30 utilizes an actuating assembly 36 (normally comprising foot-operated pedals) 36 to actuate a cable-driven paddle assembly 38, the principal components and operation of which are more fully discussed in U.S. Pat. Nos. 3,095,850 and 4,960,396, both of which are incorporated by reference herein. The paddle assembly controls a blade that moves in a sculling motion to propel the watercraft.

The system 30 may be mounted for use as a trolling motor means, or as a substitute for other conventional power systems (i.e., a hand oar system or a transom-mounted power motor). As described hereinafter, a user may quickly and conveniently install and adjust the system 30 in almost any type of watercraft. Conversely, the user may also quickly and conveniently remove system 30 from the watercraft.

When installed and adjusted, system 30 permits a seated user to silently maneuver the boat forwards or backwards through the water while retaining access to substantially all of the watercraft's interior. System 30 may be powered and controlled solely by the feet of a fisherman or other operator, so that the operator's hands are free during use to manipulate other devices, such as fishing rods and tackle, guns, or other sporting gear. Or as explained hereinafter, a modification is provided to adapt the system for hand operation.

In one preferred embodiment, my system 30 is secured to the bow 37 and a front seat base 39 of boat 35. System 30 comprises a subframe 40 that secures the system front 32 to bow 37. The subframe 40 also buttresses the paddle assembly 38.

Figure 5:
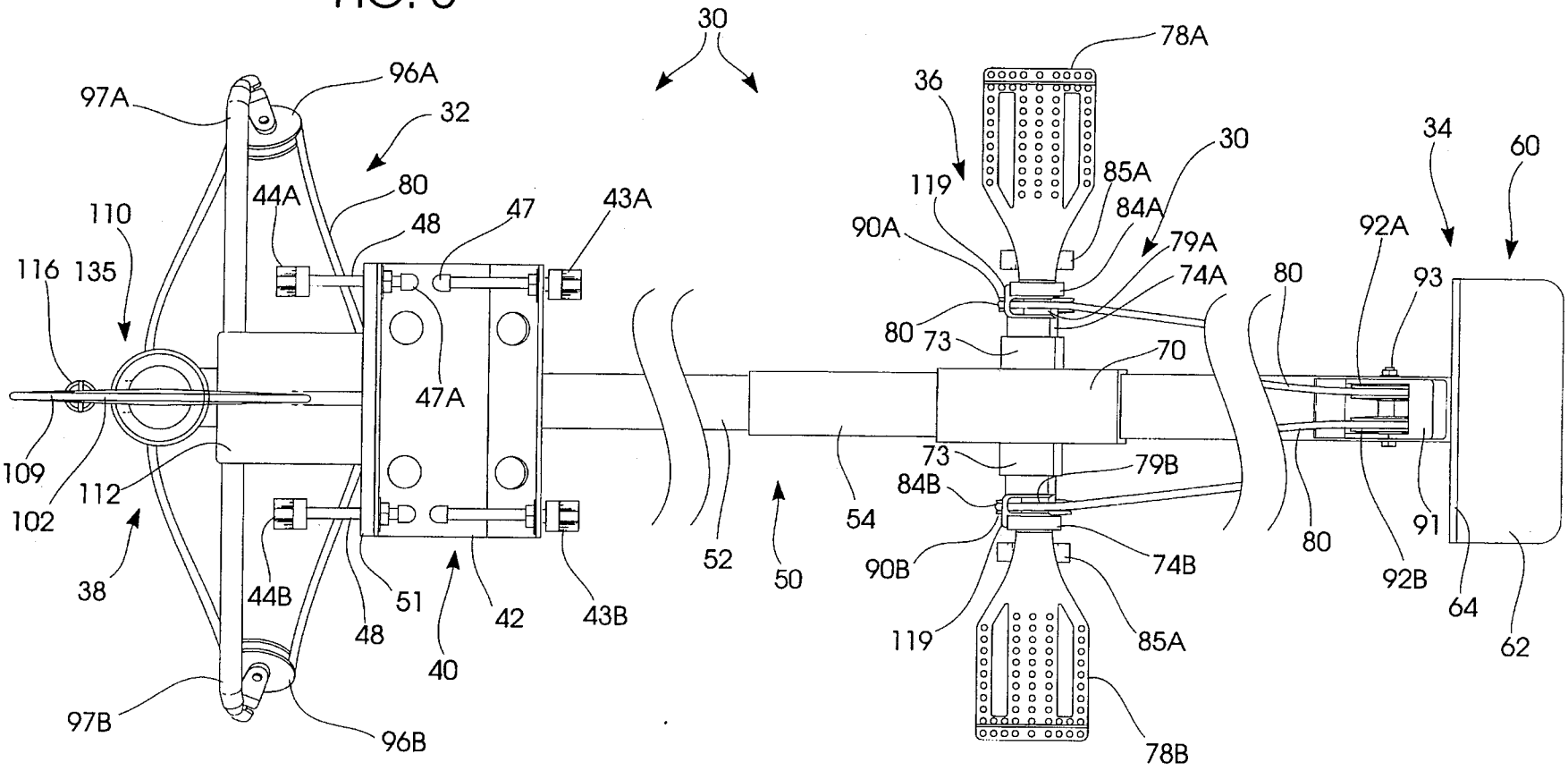
FIG. 5 is an enlarged, fragmentary bottom plan view with portions omitted or broken away for clarity.

Subframe 40 comprises a C-shaped bow plate 42 and two sets of adjustable and opposed lock knobs 43A, 44A and 43B, 44B. Each of these large, easily grasped knobs top a threaded shaft 48 ending in a resilient tip 47, 47A (FIGS. 1, 1A, 5). Knobs 43A, 44A and 43B, 44B pinch down on bow 37 to secure subframe 40. A sliding nut 41 threadably penetrated by shaft 48 is captivated within an elongated slot 49 formed in the side of bow plate 42. A portion of the bow is captivated between opposed tips 47, 47A when the subframe is mounted (FIGS. 1, 1A, 5). As the knobs are tightened and the subframe is secured, the frame is urged rearwardly to wedge the terminus 60 against seat base 39.

The subframe can be mated to different sizes and configurations of bows because of the indicated construction. For example, the threaded shafts 48 enable the clamping action to be adjusted towards or away from the bow. Also, the sliding nuts 41 enable vertical shifts in knob orientation. Preferably, when subframe 40 mounts to bow 37 it is oriented substantially horizontally (i.e., parallel with the water below).

Telescoping frame 50 extends from subframe 40 into the boat interior, where it preferably is urged into contact with a boat seat base. Frame 50 comprises a pair of rigid, hollow telescoping beams 52 and 54. The front frame beam 52 extends from the subframe 40 to rear frame beam 54. Preferably, front beam 52 telescopes within rear beam 54. A locking knob 56, similar to knobs 43A–44B, permits selective longitudinal adjustments in net beam length.

Front frame beam 52 terminates in pivot housing 95 (FIG. 1, 1A). Housing 95 comprises an integral, angle bracket 51 that is mated to the C-shaped bow plate 42 previously discussed. Knobs 53 (FIG. 1A) mate to a pair of upwardly projecting weld pin bolts (not shown) that are welded to the bow-plate 42. The innermost end 55 of the frame beam 52 (FIG. 1A) is received within a suitable recess defined in the receptor plate 57 of the pivot housing.

The rear frame beam 54 extends rearwardly to a terminus 60. Preferably, frame 50 slopes slightly downwardly at approximately five to eight degrees declination, between subframe 40 and a substantially horizontal terminus 60. Thus, subframe 40 and terminus 60 are substantially horizontal and parallel to each other but they are not coplanar.

Terminus 60 rests upon a seat base 39 to secure the system rear 34 thereto. Terminus 60 comprises two intersecting plates. A horizontal mounting plate 62 sits atop seat base 39 while vertical butt plate 64 rests against the side of seat base 39. When the system is installed (i.e., during hand tightening of knobs 43A after previous tightening of knob 56) the terminus plates 62, 64 will "wedge" into frictional, abutting contact against the upper edge of the boat seat base. The terminus outer surface 66 will have a conventional swivel seat (not shown) mounted over it during use. The swivel seat will be clamped in position on the boat seat base. Plates 62 and 64 should be optimally configured to mate with the swivel seat assembly. Thus the swivel seat, and the weight of the seated operator, assist in stabilizing the system.

Figure 3:
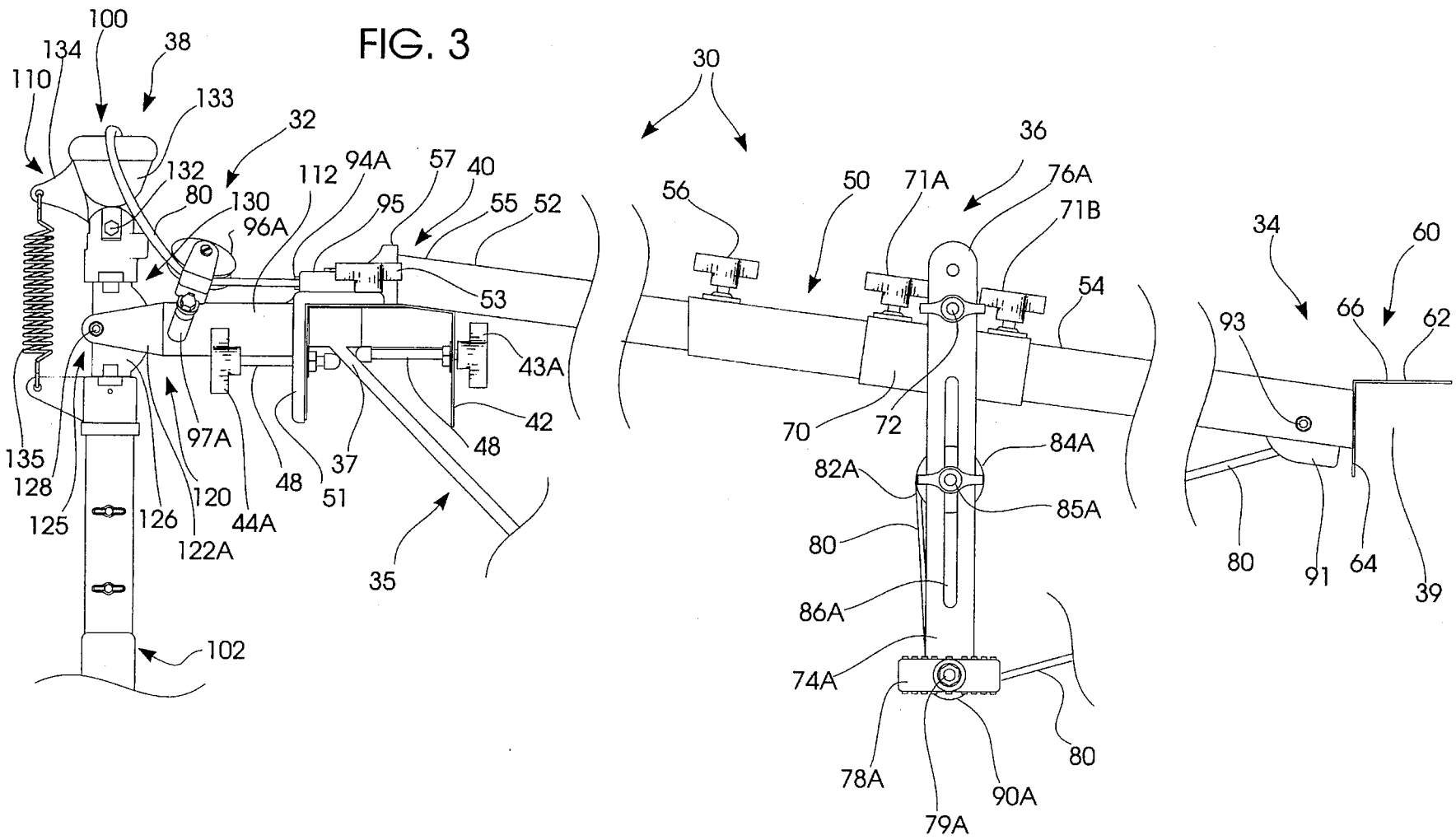
FIG. 3 is an enlarged, fragmentary side elevational view similar to FIG. 2, with portions broken away or omitted for clarity.
Figure 4:
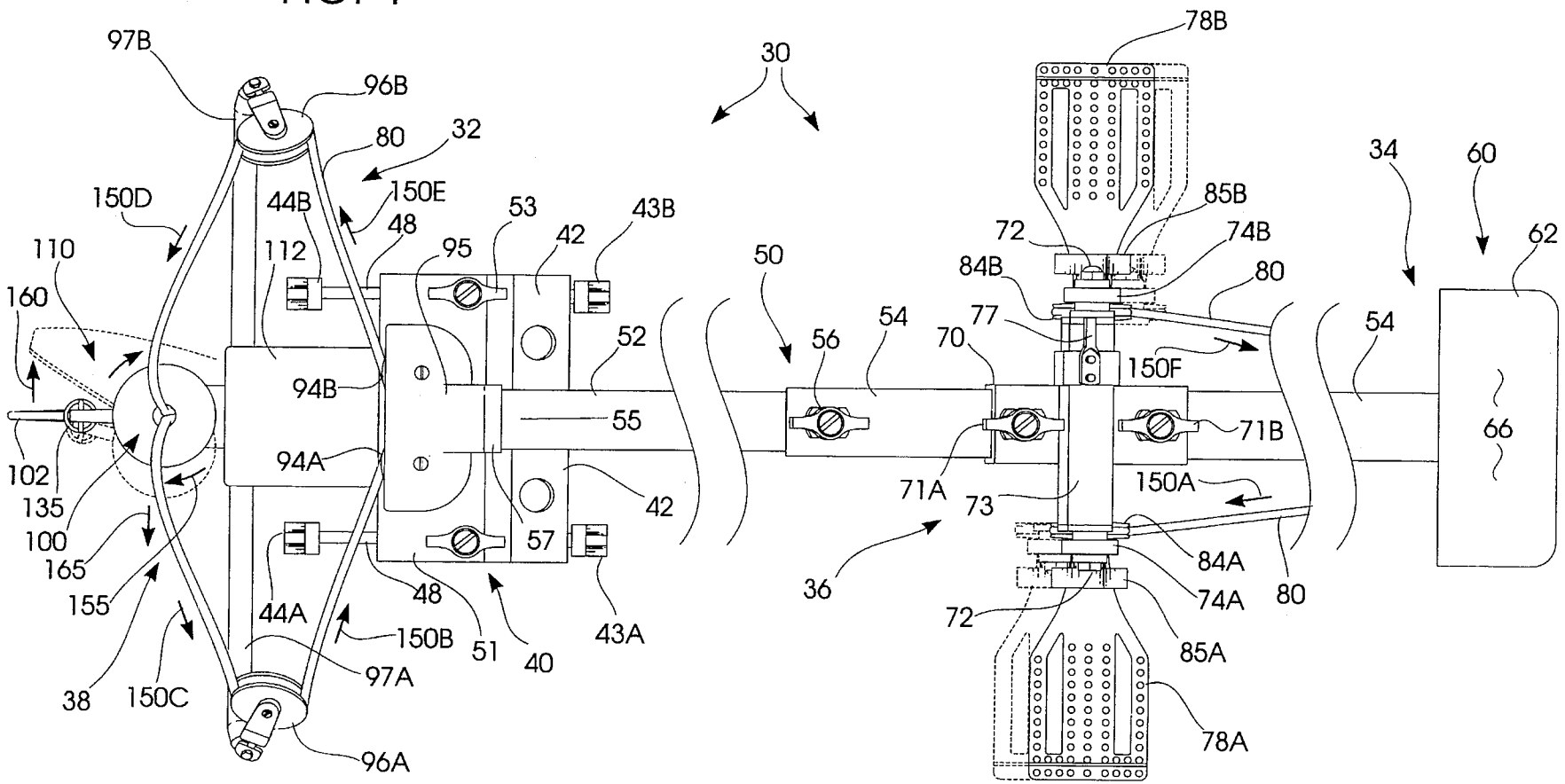
FIG. 4 is an enlarged, fragmentary top plan view with portions broken away or omitted for clarity and with dashed lines showing moved positions.

The actuating assembly 36 is seen best in FIGS. 1, 3 and 4, is secured to the frame at a desired location. In the preferred embodiment, assembly 36 depends from rear frame beam 54. Of course, with appropriate modifications, it could also be coaxially mated to front beam 52. Assembly 36 comprises a sleeve 70 that fits around a portion of beam 54. Sleeve 70 selectively slides along beam 54 during installation to enable a user to adjust the distance of the assembly 36 from seat 39 for comfort and convenience. A pair of adjustment knobs 71A, 71B, similar to knobs 43A–44B, permit longitudinal adjustment of sleeve 70. Thus, a user can selectively adjust the placement of the sleeve 70 on beam 54 as well as adjusting the overall combined length of beams 52 and 54. Therefore, system 30 can be placed almost anywhere in boat 35. It is to be particularly noted that the system works nearly as well in the back of boat 30 as it does in the front.

A transverse spindle sleeve 73 extends transversely across mounting sleeve 70. An axle 72 extends coaxially within sleeve 73 between twin, elongated pedal arms 74A and 74B. Arm tops 76A and 76B each pivotally mount on an opposite end of axle 72 to permit the arms to be moved during peddling. A sliding bar 77 locks behind arm top 76B (FIG. 1) to selectively, temporarily lock arms 74A and 74B in either the forwardmost or rearmost movement position. This permits the blade to be quickly pivoted out of the water and locked in a secure, out-of-the way position. For example, when driving the boat across the water with a high power motor or when banking the boat it is important to get the blade out of the way.

Figure 7:
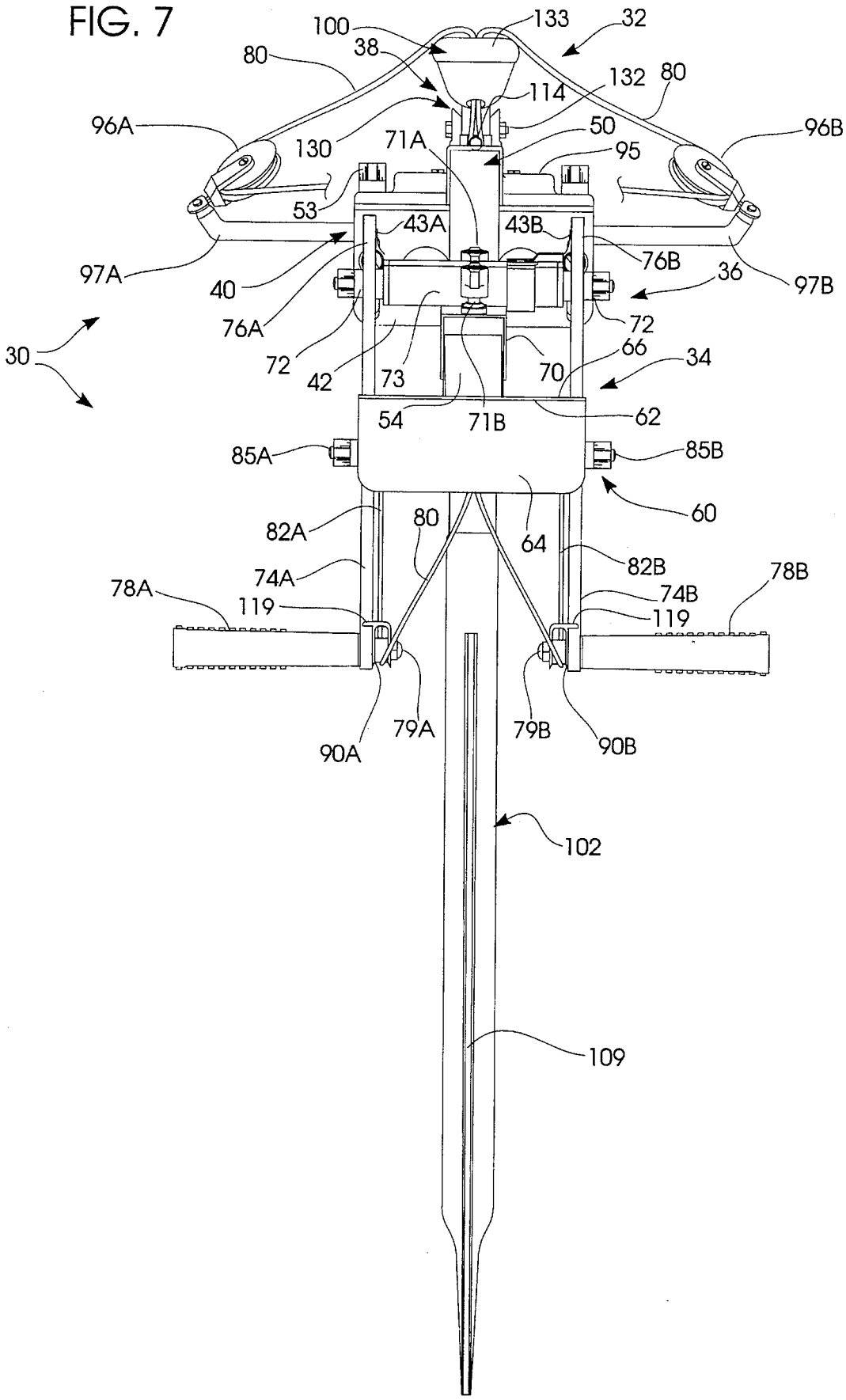
FIG. 7 is an enlarged, rear elevational view.
Figure 11:
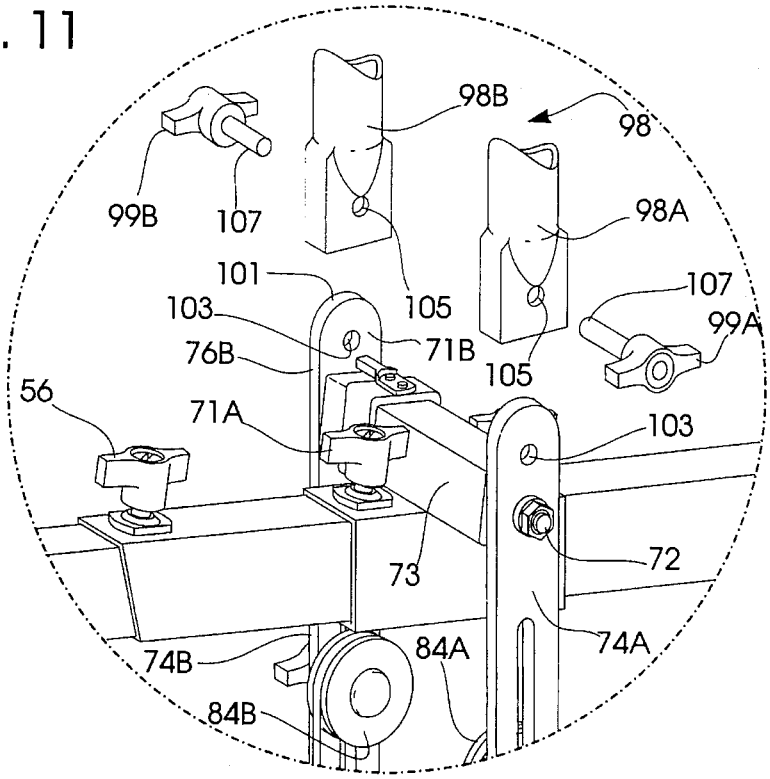

Pedal arms 74A and 74B each depend downwardly from sleeve 73. Arms 74A and 74B rotatably mount pedals 78A and 78B on appropriate bolts 79A, 79B (FIG. 7). During use, pedals 78A, 78B may be foot driven by a user to propel boat 35 (FIG. 4). With reference to FIG. 11, an optional hand bar system 98 is shown. Hand bar system 98 comprises a pair of swaged, tubular extensions 98A and 98B that mount to the tops 101 of the pedal arms 74A, 74B to extend them for hand use. Tops 101 have internally threaded orifices 103 to be aligned with extension holes 105 for locking by threaded knob shafts 107. The lock knobs 99A, 99B thus attach the hand bars for use. When it is desired to propel the system with one's hands, or with both the hands and the feet, these optional hand bars can be quick connected for immediate use.

The pedals 78A, 78B are linked to the paddle assembly 38 by cabling 80. Preferably, cabling 80 comprises a preselected length of aircraft stranded steel covered with a waterproof jacket of nylon or similar material approximately twenty feet in length. Cabling 80 comprise one continuous cable or multiple segments of cables.

Figure 6:
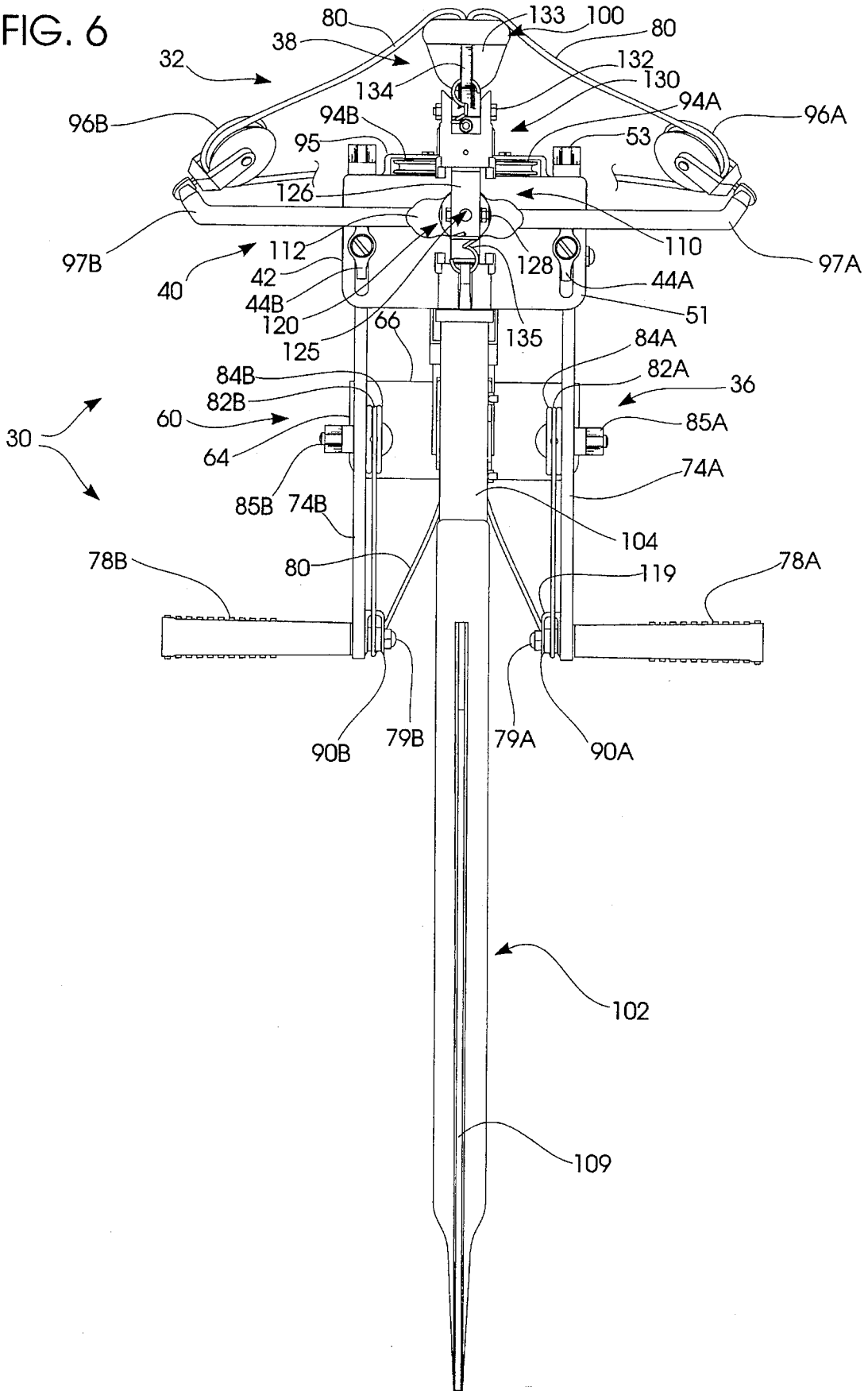
FIG. 6 is an enlarged, front elevational view.

In the preferred embodiment, the terminal cabling ends 82A and 82B are anchored within spools 84A and 84B (FIG. 6). Spools 84A and 84B are slidably mounted to each arm 74A, 74B respectively by lock knob bolts 85A, 85B. Spool movements are facilitated by an elongated follower slot 86A and 86B defined in each arm 74A, 74B. Slots 86A and 86B each receive a protruding bolt from spool 84A and 84B respectively. Thus, spools 84A and 84B may be wound to remove slack from cable 80. Spools 84A and 84B may also slide either upwardly or downwardly to remove additional slack from cabling 80 to tension it as necessary. Since the cabling can be spooled in or out as desired, the pedals associated with actuating assembly 36 can be further adjusted to accommodate a particular user's needs or for fine-tuning to increase the efficiency of system 30.

In the preferred embodiment, frame 50 houses a substantial portion of cabling 80. In other words, cabling 80 runs along the inside of beams 52 and 54, where it is protected. This arrangement prevents fouling of the cable while preventing possible injuries to the user from cable entanglement or other accidents. It also permits substantially the entire inside of the boat to be conveniently accessed by a user. It is to be noted that the housed portions of the cable may alternatively be replaced by conventional rods that are internally attached to the upper ends of each respective drive pedal.

Cabling 80 runs along three sets of pulleys between anchor spools 84A, 84B and paddle assembly 38. (FIGS. 1, 4). The cable starts at each end in an anchor spool 84A, 84B, and proceeds downwardly along the pedal arms 74A, 74B around guide spools 90A and 90B (FIG. 1). The lower guide spools 90A and 90B are captivated between pedal arm 74A and 74B and cap nuts on spindles 79A or 79B respectively. Spools 90A and 90B hold the slack created from pedal motion and redirect the cabling toward terminus 60. Spools 90A and 90B are retained from spinning by flanges 119 (FIGS. 1, 7) that extend around the edge of the pedal arms.

With reference directed primarily to FIGS. 1, 4 and 5, each cable end proceeds rearwardly towards terminus 60, being received within rear pulley block 91 and entrained about dual pulleys 92A, 92B therewithin that feed cable 80 into frame 50. Pulley block 91 protrudes from the bottom of beam 54 near terminus 60 (FIG. 3). Pulley block 91 supports aligned pulleys 92A and 92B (FIG. 5) that are journalled for rotation by pin 93.

The cabling exits at the subframe (FIGS. 4, 6) at the longitudinally spaced-apart front pulleys 94A and 94B within front pulley housing 95. Pulleys 94A, 94B feed the cable out of frame 50 at pivot housing 95 from the top of subframe 40. The cabling is directed laterally outwardly towards guide pulleys 96A and 96B (FIG. 4). Pulleys 96A and 96B are mounted on the laterally outwardly extending spreader rods 97A and 97B respectively. Cabling 80 then proceeds into a cable donut guide 100 atop paddle assembly 38. As seen best in FIG. 7, cabling exits the donut and is anchored with bolt 114.

Paddle assembly 38 comprises a rigid paddle 102 controlled by a steering assembly 110. Paddle 102 is preferably adjustably mounted with a rigid, tubular shaft 104 that coaxially engages inner shaft 104A (FIG. 1). Shaft 104, 104A are assembled with bolts 106 to which the wing nuts 108 are fastened. Paddle 102 may be vertically adjusted to vary the depth of blade 109 in the water. Paddle blade 109 has an upper orifice 111 (FIG. 1) for interconnection with a rope or tie-down to firmly maintain it in a clearance position during transportation of the boat.

Shaft 104 is operatively associated with a mechanical steering system generally designated by the reference numeral 110. System 110 is operatively, pivotally mounted upon a rigid housing 112. Housing 112 integrally abuts subframe 40 and housing 112 supports pulley spreader rods 97A, 97B oppositely subframe 40. The steering system 110 is operatively linked to the cooperating foot pedals 78A, 78B by the flexible cabling 80, as described hereinbefore. Cable 80 is secured within a rotatably mounted cable guide donut 100 associated with the paddle shaft 104. The cable guide donut 100 is adapted to rotate in response to manipulation of the pedals 78A, 78B (FIG. 1) to effectuate a change of travel direction, as described in U.S. Pat. Nos. 3,095,850 and 4,960,396, both previously incorporated by reference. The cabling 80 is guided into the interior of cable guide donut 100 and semi-permanently anchored upon a rigid set screw 114 (FIG. 7).

The preferred steering assembly 110 broadly comprises a rigid, rotatably mounted, spring-biased cable guide donut 100 operatively associated with a cam 125. The steering assembly 110 is preferably permanently, operatively supported by the rigid housing 112 upon a pivoting bracket 120 that permits the entire paddle assembly 38 to rotate parallel to bow 37.

Bracket 120 pivots about a centered, internal bolt (not shown). Bracket 120 comprises spaced-apart pairs of tabs 122A, 122B that protrude outwardly from base 123. Bracket 120 supports the pivotal cam 125. Cam 125 comprises a vertically oriented cam body 126 that has a generally D-shape. The flat body is sandwiched between tabs 122A, 122B. A rigid pin 128 penetrates cam 125 to captivate it within bracket 120. Cam 125 permits the entire actuating assembly 36 to rotate substantially perpendicularly to bow 37.

The upper cam edge rigidly supports a pedestal 130 while the upper end of paddle shaft 104 protrudes downwardly from the lower cam edge. Pedestal 130 protrudes upwardly from cam 125 to support donut 100. A pin 132 penetrates the upper section of pedestal 130. Pin 132 rotatably attaches donut 100 to pedestal 130. Thus, donut 100 may rotate perpendicularly to bow 37. An internal biasing system prevents cam 125 from rotating before donut 100 (not shown). Cable guide donut 100 preferably comprises a hollow, semicircular cylindrical head 133 having a lower stem adapted to be coaxially fitted within pedestal 130 and a spring tab 134.

A flexible spring 135 (FIG. 3) operatively associated with the guide donut 100 facilitates operation of the system 30. A lighter weight spring may easily be substituted so that a child or other person with less manual strength may easily and conveniently operate the device. Use of the assembly by a child would require repositioning of the foot pedal assembly relative to the boat seat, which may be accomplished by repositioning the actuating assembly 36 at a desired position.

The recoil spring 135 extends lengthwise parallel to paddle 102 between shaft 104 and the cooperating tab 134. The spring 135 biases cable guide donut 100 against rotation relative to cam body 126. When tension is applied to cabling 80 by manipulation of either foot pedal 78A or 78B, donut 100 rotates accordingly within pedestal 130 and urges the paddle shaft 104 to rotate correspondingly. When non-zero pressure is applied both pedals 78A, 78B, cabling 80 effectively pulls against donut 100. If enough non-zero pressure is applied, it eventually "breaks" the biasing force of spring 135 and donut 100 flips over (as described in the prior patents). As soon as the non-zero pressure relaxes sufficiently, spring 135 returns the donut 100 to the biased position.

Figure 8:
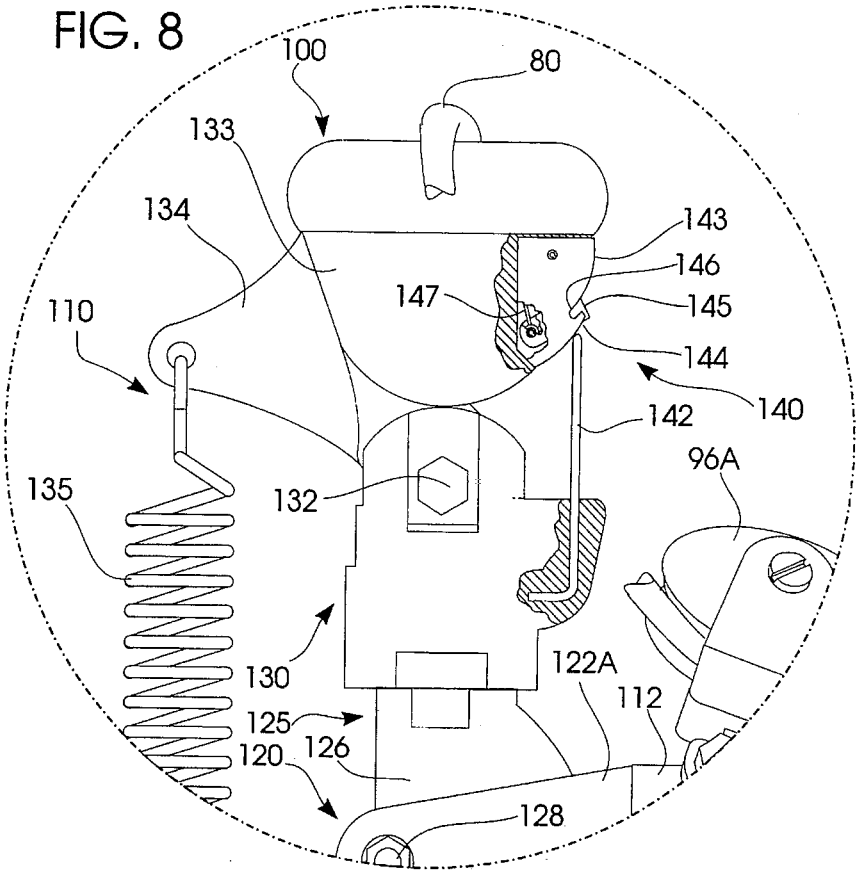
FIG. 8 is an enlarged, fragmentary side elevational view showing an optional lock in an unlocked configuration, generally taken from the area circled in FIG. 2, with portions broken away or omitted for clarity.
Figure 9:
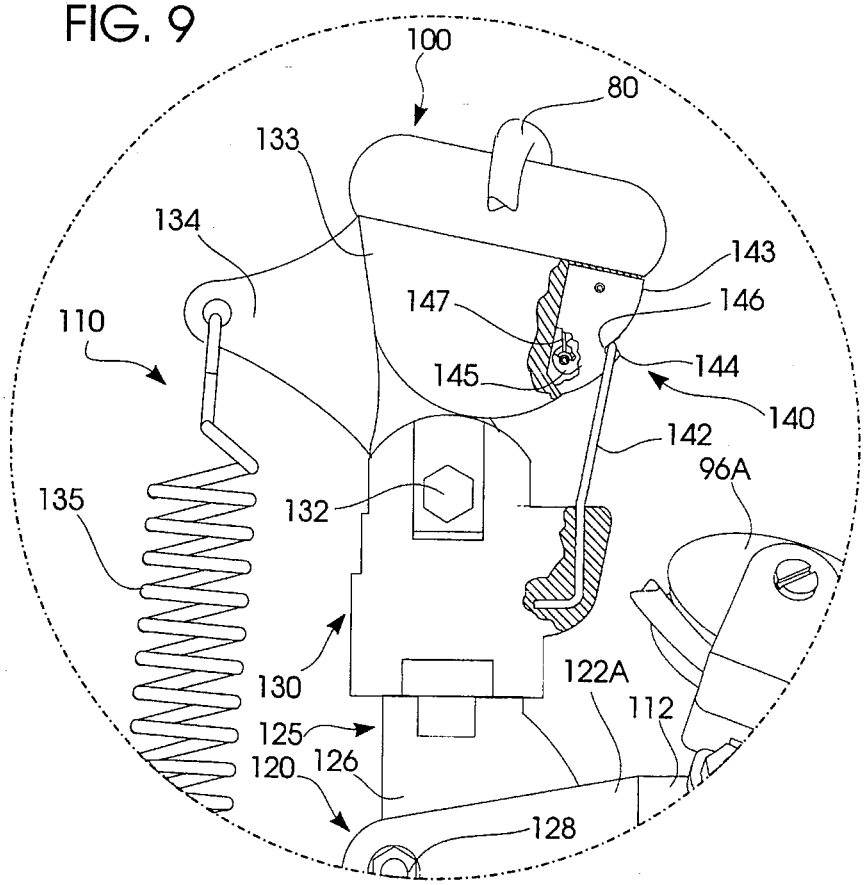
FIG. 9 is an enlarged, fragmentary side elevational view similar to FIG. 8 but showing the optional lock in a locked configuration, generally taken from the area circled in FIG. 2, with portions broken away or omitted for clarity.
Figure 10:
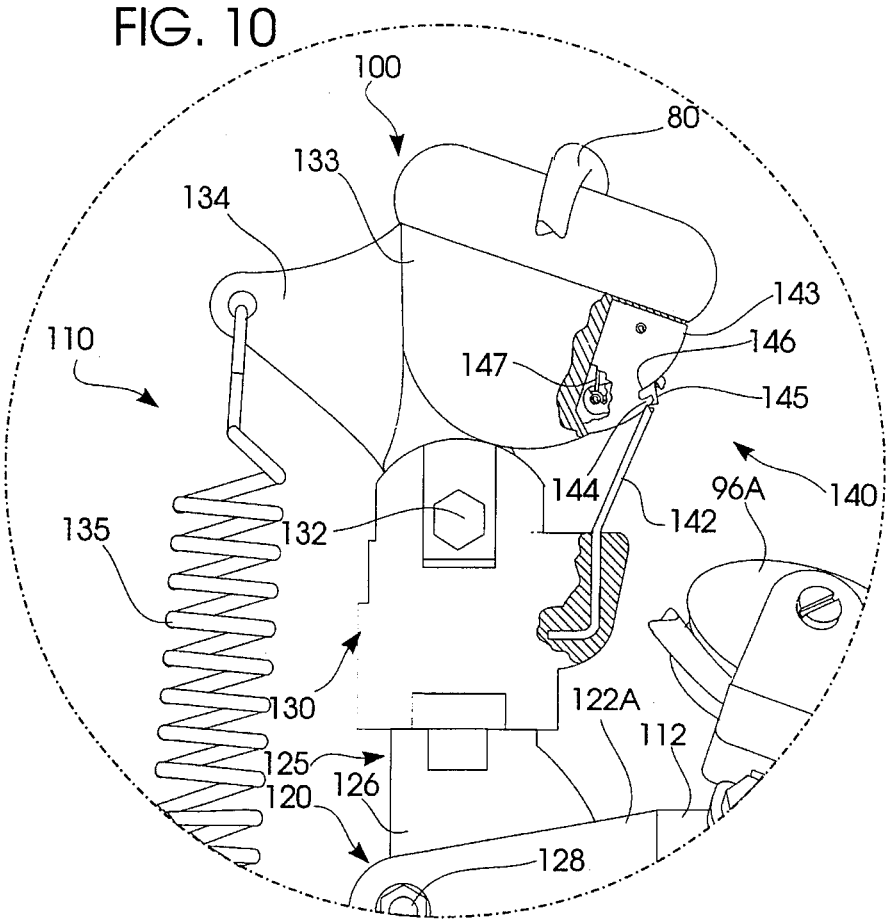
FIG. 10 is an enlarged, fragmentary side elevational view similar to FIGS. 8 and 9 but showing the optional lock in a released configuration, generally taken from the area circled in FIG. 2, with portions broken away or omitted for clarity; and, FIG. 11 is an enlarged, fragmentary isometric view showing an alternative design feature comprising optional hand bars for hand operation of the system.

A novel lock 140 may be employed to maintain a selected donut position even if the applied pressure relaxes completely. The lock 140 comprises a keeper 142 that cooperates with a tongue 144 to maintain a selected donut position (FIGS. 8–10).

Keeper 142 comprises a looped wire body anchored in pedestal 130 near pin 132. As donut 100 rotates about pin 132, keeper 142 is deflected by the donut periphery 143. As keeper 142 travels upwardly along the periphery 143, it encounters a tongue 144 covered by a rotatable guard 145. Continued keeper travel along the periphery deflects guard 145 to expose a depression 146. Keeper 142 may become seated in depression 146 if the pressure applied to donut 100 is appropriately relaxed while guard 145 is deflected. A spring 147 biases guard 145 over depression 146.

Operation

In use, the system 30 is quickly and conveniently installed in boat 35 by coupling subframe 40 to bow 37 and mounting terminus 60 on seat base 39. Subframe bolts 43A, 43B, 44A and 44B may then be tightened to pinch down on bow 37 to secure the subframe 40 thereto. The frame 50 may be longitudinally adjusted as necessary to accommodate various boat sizes. Beam 52 may be telescoped in or out of beam 54 by loosening bolt 56 and retracting or extending beam 52 as desired. Bolt 56 is tightened to secure beam 52 in beam 54 after a desired length is obtained.

Removal of system 30 is easily accomplished by loosening bolts 43A, 43B, 44A and 44B to permit the subframe 40 to be removed from the bow 37. Next, terminus 60 simply lifts upwardly away from the seat 39. The frame 50 may be compacted by loosening bolt 56 and retracting beam 52 into beam 54.

Assembly 36 may be adjusted by loosening bolts 71A and 71B and sliding the assembly along beam 54 until a desired position is obtained. Any slack in drive cabling 80 may be retracted by loosening spools 84A and 84B and winding up slack in cabling 80 appropriately before retightening the spools. Once properly adjusted, system 30 may be operated by a user to propel boat 30.

During propulsion, the system 30 permits a fisherman, hunter or other user to maneuver the watercraft forwardly or rearwardly through the water in response to manipulation of the foot pedals 78A, 78B, while the fisherman's hands remain free for operation of other fishing or sporting equipment (FIG. 4).

Although a detailed disclosure of the operation of the paddle is included in U.S. Pat. Nos. 3,095,850 and 4,960,396, it may be briefly summarized as follows. A seated user pushes pedal 78A forwardly, which pulls cabling 80. In other words, as pedal 78A moves forwardly (and pedal 78B moves rearwardly), cabling 80 moves in the direction indicated by arrows 150A–F. As cabling 80 moves, its offset attachment to donut 100 at screw 114 forces donut 100 to first rotate as indicated by arrow 155. The donut rotation causes paddle 102 to rotate as indicated by arrow 160, thus establishing a particular paddle pitch. Continued cable movement moves the upper end of the paddle assembly 38 as indicated by arrow 165. As the upper end moves, the paddle assembly rotates about bracket 120 (as indicated by arrow 170) and the paddle blade 102 moves forcefully through the water to propel boat 35.

In the prior incorporated patents, non-zero tension on both pedals 78A, 78B forced the donut 100 to flip over. Such flipping caused a different paddle pitch, which reversed boat direction. Spring 135 automatically returns donut 100 when the user relaxes tension on cabling 80. As previously noted, requiring continued tension on cabling 80 could tire some users. However, as can be seen in FIG. 9, spring lock 140 prevents donut 100 from returning to its spring biased position.

To lock donut 100 in the flipped position, a user applies pressure to both pedals 78A, 78B until donut 100 rotates toward the user. As the donut rotates, keeper 142 moves outwardly and upwardly along an insert 143. As keeper 142 moves upwardly along the periphery of donut 100, it rides over insert tongue 144 where it deflects guard 145. If the pressure applied to donut 100 relaxes before keeper 142 leaves the tongue depression 146, keeper 142 will seat itself in tongue 144. Until unlocked, keeper 142 will remain seated in tongue 144, maintaining donut 100 in the flipped position.

To unlock donut 100, the user applies pressure to both pedals 78A, 78B until exceeding the pressure required to originally lock the donut in the configuration shown in FIG. 9. As the pressure exceeds the locking tension, keeper 142 dislodges from its seat in tongue 144 and it again moves upwardly along the periphery of donut 100. When keeper 142 leaves depression 146, a spring 147 forces guard 145 back into its seated position over depression 146. If the pressure applied to donut 100 relaxes, keeper 142 will simply slide over guard 145. In other words, guard 145 now prevents keeper 142 from seating itself in depression 146. As a result, when the pressure applied to donut 100 relaxes, the donut will return to its normal, spring-biased position.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A human-powered propulsion system for boats, the propulsion system comprising:

frame means for mounting the propulsion system upon a boat, said frame means comprising a subframe adapted to be coupled to the bow or stern of the boat and a spaced apart terminus for engaging the boat interior;

paddle means mounted to said subframe and normally aimed downwardly toward the water for propelling the boat;

foot-driven actuating means for actuating said paddle means, said actuating means comprising a mounting sleeve coaxially, slidably mounted to said frame means that is adapted to be positioned at a user selected location between said subframe and said terminus, a spindle sleeve mounted to said mounting sleeve, and a pair of arms pivotal relative to said spindle sleeve with a foot pedal projecting from each arm;

cable means extending from said actuating means through at least a portion of said frame means to said paddle means for operating same; and, adjustably mounted anchor spool means for terminating said cable means.

2. The propulsion system as defined in claim 1 wherein said cable means is entrained about pulleys associated with said frame means terminus.

3. The propulsion system as defined in claim 1 wherein said cable means interiorly penetrates said frame means and exits said frame means at said subframe for routing to said paddle means.

4. The propulsion system as defined in claim 3 wherein said frame means is telescopingly extensible.

5. The propulsion system as defined in claim 3 further comprising hand bar means adapted to be coupled to said actuating means for hand propelling the boat.

6. A human-powered propulsion system for boats, said propulsion system comprising:

elongated, telescoping frame means adjustably extending between a boat seat base and the boat bow for mounting the system, said frame means comprising a subframe secured to said bow and a spaced apart terminus adapted to be wedged into contact interiorly of the boat;

paddle means pivotally mounted to said subframe adjacent the bow and normally aimed downwardly toward and into the water for propelling the boat;

pedal means for actuating said paddle means from a position within the boat, wherein said pedal means is adjustably slidable along said frame means into an operative position between said subframe and said terminus, said pedal means comprising a mounting sleeve coaxially mounted to said frame means that is adapted to be positioned at a user selected location within the boat, a spindle sleeve transversely mounted to said mounting sleeve, a pair of arms pivotal relative to said spindle sleeve, and a foot pedal projecting from each arm;

drive cable means interconnecting said pedal means with said paddle means; and, anchor spool means adjustably mounted upon each arm for terminating said drive cable means.

7. The propulsion system as defined in claim 6 wherein said cable means is entrained about pulleys associated with said frame means terminus.

8. The propulsion system as defined in claim 6 wherein said cable means interiorly penetrates said frame means and exits said frame means at said subframe for routing to said paddle means.

9. The propulsion system as defined in claim 6 further comprising resilient locking means for controlling the pitch of said paddle means.

10. A human-powered propulsion system for boats, said system comprising:

telescoping frame means extending between a subframe secured to the boat bow and a spaced apart terminus wedged to the boat interior, wherein said subframe comprises mounting means for enabling it to be fitted to differently sized and shaped boats;

paddle means pivotally mounted to said subframe adjacent the bow for propelling the boat;

actuating means for activating said paddle means from a position within the boat with either the foot or hands or both, said actuating means slidably mounted to said frame means between said subframe and said terminus by a sleeve coaxially mounted to said frame means that can be positioned at a user selected location between said subframe and said terminus and temporarily locked in a deployed position;

wherein said actuating means comprises a pair of arms pivotally mounted to said sleeve and a pedal projecting from each arm, and hand bar means adapted to be coupled to said arms for hand propelling the boat;

cable means interconnecting said actuating means with said paddle means, a portion of said cable means being internally routed through said frame means and a portion of said cable means being entrained about pulleys for connection to said paddle means; and, adjustably mounted anchor spool means for terminating said cable means interiorly of said boat.

11. A human-powered propulsion system for boats, the propulsion system comprising:

telescoping frame means for adjustably mounting the propulsion system within and upon a boat, said frame means adapted to be coupled between the bow or stern of the boat and a seat within the boat interior substantially at the center of the boat;

paddle means for propelling the boat through water;

foot driven pedal means for actuating said paddle means, said pedal means slidably mounted to said frame means and adapted to be positioned at a comfortable, user selected location along said frame means;

drive cable means extending from said pedal means interiorly through at least a portion of said frame means to said paddle means for operating same; and, adjustable anchor means for terminating said cable means and taking up slack or elongating said cable means in response to slidable positioning of said pedal means, said anchor means secured to said frame means within said boat.

12. A removable, portable human-powered propulsion system for boats having seats and a bow, said propulsion system comprising:

elongated, telescoping frame means adjustably extending between the boat seat base and the boat bow for mounting the system;

paddle means pivotally mounted to the boat bow and normally aimed downwardly into the water for propelling the boat;

foot driven pedal means for actuating said paddle means from a position within the boat, wherein said pedal means is adjustably slidable along said frame means into an operative position, said pedal means comprising a mounting sleeve coaxially mounted to said frame means that is adapted to be positioned at a user selected location within the boat;

drive cable means interconnecting said pedal means with said paddle means, said drive cable means extending from said pedal means interiorly through at least a portion of said frame means to said paddle means for operating same; and, adjustable anchor spool means adjustably mounted upon said pedal means for taking up cable slack or elongating said cable means in response to slidable positioning of said pedal means mounting sleeve, said anchor means secured to said frame means within said boat.

13. A human-powered propulsion system for boats, said system comprising:

telescoping frame means extending between the boat bow and the boat interior, said frame means comprising mounting means for enabling it to be fitted to different sized and shaped boat bows, a portion of said frame means adapted to be urged into contact with a boat seat at least in part by the weight of the user;

paddle means mounted to said subframe adjacent the bow for propelling the boat;

pedal means for activating said paddle means from a position within the boat, said pedal means slidably mounted to said frame means by a sleeve coaxially mounted to said frame means that can be positioned at a user selected location and temporarily locked in a deployed position;

cable means interconnecting said pedal means with said paddle means, a portion of said cable means being internally routed through said frame means and a portion of said cable means being entrained about pulleys for connection to said paddle means; and, adjustably mounted anchor spool means for terminating said cable means interiorly of said boat.

* * * * *